US008525008B2

(12) United States Patent
Babicz

(10) Patent No.: US 8,525,008 B2
(45) Date of Patent: Sep. 3, 2013

(54) STRINGED INSTRUMENT STRING ACTION ADJUSTMENT

(76) Inventor: Jeffrey T. Babicz, Newburgh, NY (US)

( * ) Notice: Subject to any disclaimer, the term of this patent is extended or adjusted under 35 U.S.C. 154(b) by 62 days.

(21) Appl. No.: 13/063,011

(22) PCT Filed: Jan. 14, 2010

(86) PCT No.: PCT/US2010/021025

§ 371 (c)(1),
(2), (4) Date: May 31, 2011

(87) PCT Pub. No.: WO2010/083295

PCT Pub. Date: Jul. 22, 2010

(65) Prior Publication Data

US 2011/0259171 A1 Oct. 27, 2011

Related U.S. Application Data

(60) Provisional application No. 61/205,015, filed on Jan. 15, 2009.

(51) Int. Cl.
*G10D 3/04* (2006.01)

(52) U.S. Cl.
USPC ..... 84/298

(58) Field of Classification Search
USPC ..... 84/298, 312 R, 313
See application file for complete search history.

(56) References Cited

U.S. PATENT DOCUMENTS

| | | | | |
|---|---|---|---|---|
| 5,171,927 | A | 12/1992 | Kubicki et al. | |
| 5,208,410 | A | 5/1993 | Foley | |
| 6,867,354 | B2 * | 3/2005 | Shimooka et al. | 84/312 R |
| 7,638,697 | B2 * | 12/2009 | Moore | 84/298 |

FOREIGN PATENT DOCUMENTS

| | | | |
|---|---|---|---|
| JP | 2000-187482 | A | 7/2000 |
| KR | 10-0188558 | B1 | 6/1999 |

OTHER PUBLICATIONS

International Search Report for PCT/US10/21025, dated Aug. 30, 2010.

* cited by examiner

*Primary Examiner* — Kimberly Lockett
(74) *Attorney, Agent, or Firm* — Heslin Rothenberg Farley & Mesiti, P.C.

(57) ABSTRACT

A stringed musical instrument comprises of a headstock with tuners, a neck having a fretboard, a body having a top and back, a saddle with a bridge secured to the body and one or more strings stretched from the headstock over the neck, fretboard, and over a portion of the top of the body to contact points on the bridge saddle. The instrument is further provided with a means for adjusting the saddles up or down in any interval to change individual string action height while the saddles maintain full contact to the body of the instrument without the employment of inferior air gaps between the bottom of the string and the instrument's body. The elimination of air gaps under the instrument's saddle or bridge offer improved sonic sustain and enhanced musical tone.

15 Claims, 9 Drawing Sheets

STRINGED INSTRUMENT STRING ACTION ADJUSTMENT

CROSS-REFERENCE TO RELATED APPLICATION

The present application is a national stage filing under section 371 of International Application No. PCT/US10/21,025,filed on Jan. 14, 2010, and published in English on Jul. 22, 2010, as WO 2010/083295, and claims priority to Provisional Application Ser. No. 61/205,015 filed 15 Jan. 2009. The entire disclosure of these applications are incorporated herein by reference and the benefit of the filing dates are claimed herein as well.

FIELD OF THE INVENTION

This invention relates to an adjustable string height mechanism for stringed musical instruments which provides full contact from the string to the body of the instrument.

DESCRIPTION OF PRIOR ART

Stringed musical instruments normally include the following elements: a headstock with tuners; a neck with fingerboard or fretboard; a body; a bridge secured to the body including a saddle; and one or more strings stretched from the headstock over the neck fingerboard and over a portion of the body to contact points on the bridge saddle. For further clarification, the invention herein applies to stringed musical instruments with a fingerboard or a fretboard, and these terms will be used interchangeably The height of the strings relative to the neck and its fretboard playing surface is generally referred to as "string action" or "action". Certain musicians prefer to have a small distance between the fretboard and string, or "low" action, which is desired for ease of fingering, while others prefer a "higher" action to avoid fret buzzing and improved musical note clarity. Action is subject to personal preference and can have a major effect on performance. Providing a musical instrument with adjustable action is desirable for utmost performance flexibility.

The invention disclosed herein is directed to a string instrument having adjustable bridge saddles positioned in a bridge, and for total adjustment flexibility, one saddle per string is preferred. The saddle should be made from rigid material such as metal or a hard polymer to aid mechanical movement, and to provide a high level of durability. The choice of saddle material can also have an effect on the tonal and sustaining response of the vibrating string.

The invention includes a mechanism for adjusting the individual string action height while the saddle/saddle housing maintains full and firm contact to the instrument's body. Providing saddles with full contact to the body is advantageous, as this eliminates air gaps between the string and body of the instrument. These undesirable gaps can rob positive string vibration transfer to the body, and gaps also reduce desirable musical sustain.

The industry standard saddle design often includes individual string height or whole bridge adjustments for utmost player action preference, but lacks a full contact to the body feature as disclosed herein. Examples of undesirable gaps between the string saddle or bridge and the instrument's body can be found in the following U.S. patents: Clarence L. Fender, U.S. Pat. No. 2,741,146, and T. M. McCarty U.S. Pat. No. 2,740,313.

In the Fender design, individual strips of metal are bent into shape with the strings resting in a groove on each saddle (FIG. 2 items 19, 21 and 22). To adjust the string action height, one would turn set screws (23) mounted in the saddles which make contact to the bridge base, therefore increasing or decreasing the height of the saddle, along with the string. The drawback to this design is the only means of desirable sound transference from the vibrating string to the body of the instrument is through the tiny point of each small set screw (23). This design also leaves large air gaps between the bottom of the saddle and top of the guitars' body, robbing musical sustain from the instrument.

The McCarty invention employs a floating bridge member which holds individual saddles (FIGS. 2 and 3). Two threaded mounting posts (11) intersect the bridge member (13) and the body (9) of the instrument. When turned, the threaded post drives the bridge up or down which in turn increase or decrease the instrument's string height action. The disadvantage to this design is the only tonal transference of string vibrations is via the two small posts (11). Also with this design, the bottom of the floating bridge to the top of the instrument's body leaves massive air gaps, which in turn rob essential and desirable musical tone and sustain from the instrument.

Consequently, it is highly desirable to have string saddles which are individually adjustable for string action height in infinite variables, all the while maintaining full contact to the instrument's body. Full contact forms a much desired string-to-body direct coupling system.

SUMMARY

Accordingly, a primary object of the present invention disclosed herein is to improve musical sustain and tone without compromising any number of individual variable string action height adjustment settings. It is advantageous to have individual, full string height adjustability while the saddle maintains firm contact to the instrument's body at the same time eliminating all air gaps between the string and the instrument's top, of which the invention presented within demonstrates.

These and other objects, features, and advantages are accomplished in accordance with the teachings of the present invention, one illustrative embodiment of which comprises a stringed musical instrument which includes a headstock with tuners; a neck having a fretboard, a body having a top and back, a saddle secured to the body; and one or more strings stretched from the headstock over the neck and fretboard, and over a portion of the top of the body to a contact point on the bridge saddle. In accordance with the invention, the instrument is provided with an adjustable saddle wherein, when adjusted, the string height changes relative to the neck, fretboard and body in infinite variables without employing air gap between the string and the instrument's body.

BRIEF DESCRIPTION OF THE DRAWING

Other objects, features and advantages of the present invention will be apparent from the following detailed descriptions and accompany drawings, wherein.

DETAILED DESCRIPTION OF THE INVENTION

Figure 1:
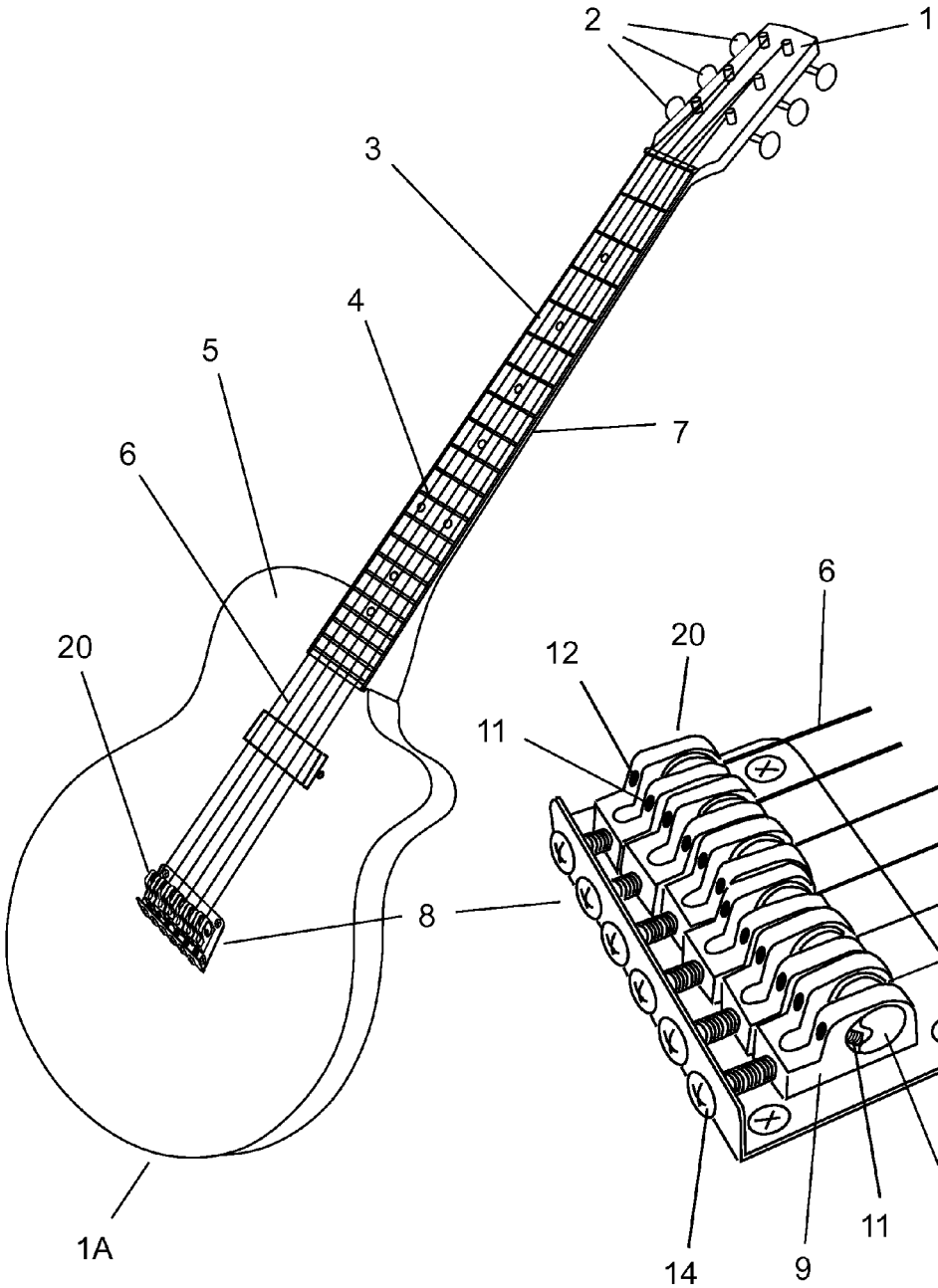
FIG. 1 is a perspective view of a stringed instrument incorporating the features of the present invention. In this embodiment the musical instrument shown is, but not limited to, a guitar.

Referring to FIG. 1 of the drawing; illustrated is a stringed musical instrument 1A. The particular instrument shown is a guitar; however the invention is equally applicable to other stringed instruments such as, but not limited to: the mandolin, banjo, bass, ukulele, and/or the bowed family of instruments. Instrument 1A is seen as including: a headstock 1 with tuning pegs or tuners 2, a neck 7 with fingerboard or fretboard 3 having frets 4 and a body 5, with saddle assemblies 20 secured to the top of a bridge 8. With the body 5, one or more strings 6 are stretched from the headstock 1 over the neck 7 and fretboard 3 and over a portion of the top of the body 5 to contact points on the bridge saddle 10.

The invention is concerned with adjustment of the height of the strings 6, individually, and relative to the neck 7, its fretboard 3, and body 5, (commonly referred to as the string's "action") while maintaining full contact to the instruments body 5.

Figure 2:
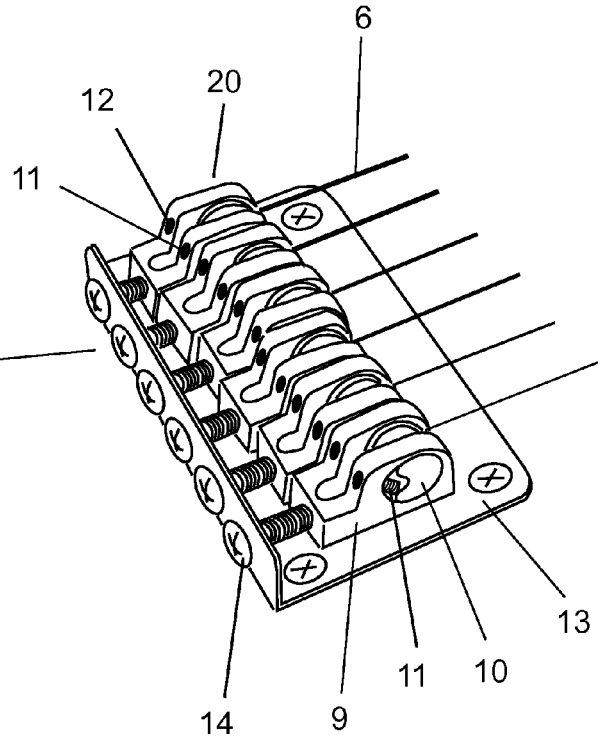
FIG. 2 shows an enlarged perspective view of the bridge assembly, which includes individual saddle assemblies that incorporate a saddle for adjusting the instrument's string action height.

FIG. 2 illustrates the primary subject of the invention, the saddle 10, and the saddle housing 9, in turn making up a saddle assembly 20.

Figure 3:
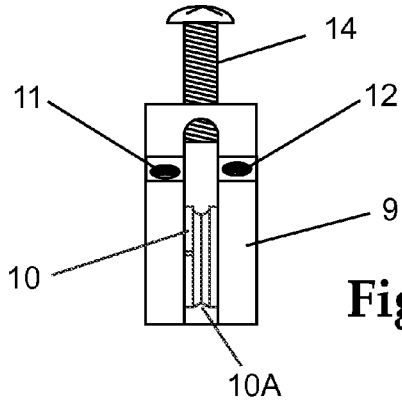
FIG. 3 is a top view of the saddle assembly. The saddle housing, saddle, string height, and saddle lock screws are visible, along with the intonation adjustment screw.
Figure 4:
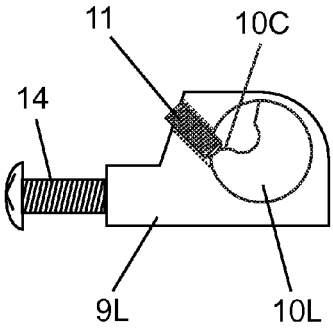
FIG. 4 is a side left view of the saddle assembly. The saddle housing, saddle, and string height adjustment screw are visible, along with the intonation adjustment screw.
Figure 5:
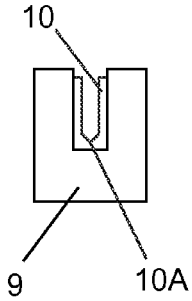
FIG. 5 is a front view of the saddle assembly. The saddle housing and the saddle are visible.
Figure 6:
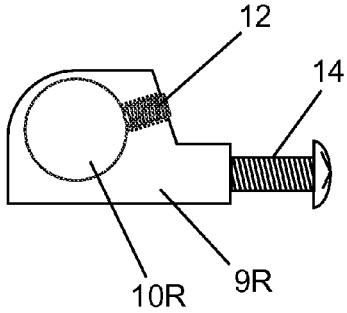
FIG. 6 is a side right view of the saddle assembly. The saddle housing, saddle, and saddle lock screw are visible, along with the intonation adjustment screw.
Figure 7:
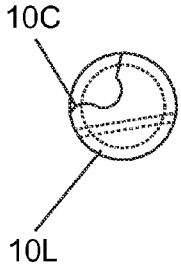
FIG. 7 is a side left, transparent view of the saddle. The lever portion of the saddle is visible.
Figure 8:
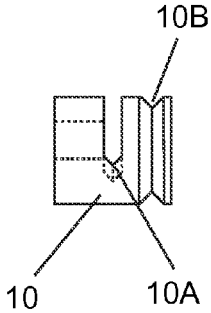
FIG. 8 is a front transparent view of the saddle. The string groove is shown, along with the saddle centering notch.
Figure 9:
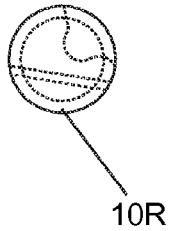
FIG. 9 is a side right, transparent view of the saddle.
Figure 10:
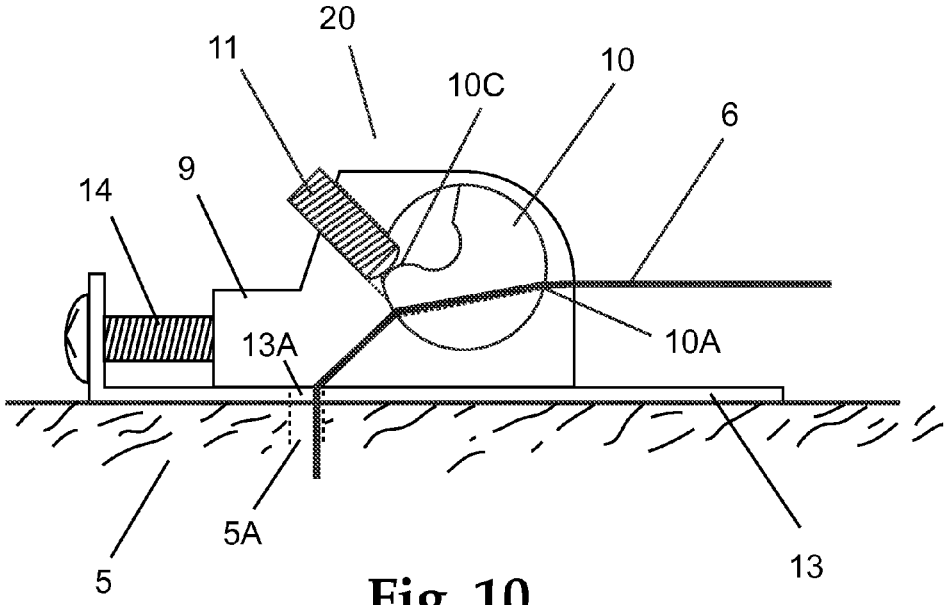
FIG. 10 is a side view of the saddle assembly mounted to a bridge plate with the intonation adjustment screw engaged and a string installed. Using the saddle height adjustment screw, the saddle is adjusted with the string height set at its lowest string action height setting.
Figure 11:
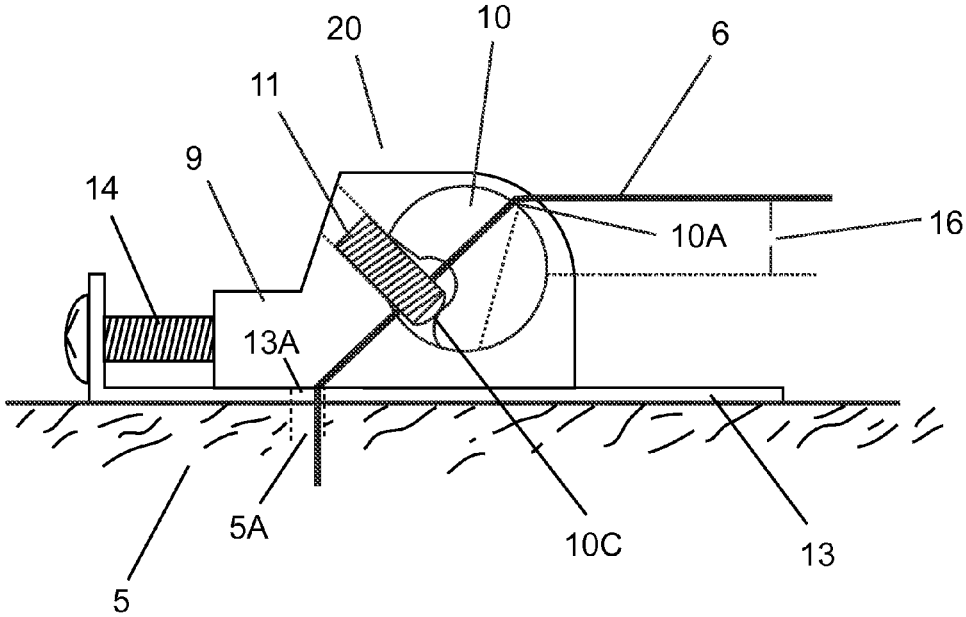
FIG. 11 is a side view of the saddle assembly mounted to the bridge base with the intonation adjustment screw engaged and a string installed. Using the saddle height adjustment screw, the saddle is adjusted with the string height set at its highest string action height setting.

FIG. 3-11 demonstrate embodiments of how the new invention here within works. FIGS. 10 and 11 show a side cross section enlargement view of the saddle invention. In this example; to use the saddle height adjustment feature, one would first install a string 6 by threading it through a hole 5A in the instrument body 5, passing the string through a hole in the bridge plate 13A, then onto the string groove 10A found in the saddle 10, then connect the string to the instrument's tuner 2. Then to make individual string action height adjustments one would loosen the locking set screw 12, FIGS. 3 and 6, and then turn the height adjustment screw 11, FIGS. 3 and 4, to raise the leading edge of the string groove 10A up or down, which in turn raises or lowers the string 6. Once the desired string action height is achieved, and to complete the adjustment, the saddle 10 is locked into place by turning the locking set screw 12, mounted in the saddle housing 9, into the saddle centering notch 10B found on the saddle 10 as seen in FIGS. 3, 6, and 8.

FIG. 7 shows a left side view 10L, of the saddle 10, which includes a serpentine shaped recess lever portion 10C. It is desired to have the saddle 10 fit into the saddle housing 9 snugly, but with enough clearance to allow the saddle 10 to rotate in the saddle housing 9. FIG. 8 also shows a saddle centering notch 10B cut into the saddle 10, which when engaged with the saddle locking set screw 12, FIG. 6, prevents the saddle 10 from shifting sided-to-side, or from rotating in the saddle housing 9.

FIG. 10 shows a side view cross section of the height adjustment screw 11 turned outward, and the end of the screw 11 is engaged with the recess lever 10C. In this position the leading edge of the string groove 10A holds the string 6 in its lowest action height setting. Conversely, FIG. 11 shows the height adjustment screw 11 turned inward, pushing on the recess lever 10C, which in turn allows encapsulated saddle 10 to rotate in the saddle housing 9 upward, therefore moving the leading edge of the string groove 10A, and the string 6 upward in unison. The string height adjustment range is shown as item 16, found in FIG. 11.

As demonstrated in FIGS. 10 and 11, it is important to note that throughout the entire string height adjustment range 16; as the saddle 10 rotates in saddle housing 9, the string 6 always makes contact with the saddle 10, which in turn makes full contact with the saddle housing 9, which in turn makes full contact with the bridge plate 13, which is mounted directly to the instrument's body 5. This method insures the utmost positive string vibration transfer to the instrument's body 5 and insures utmost sonic sustain with improved tonal response of the vibrating string 6.

It may be desirable to have the saddle assembly 20, FIGS. 10 and 11, equipped with a fine adjustment intonation screw 14, which can be affixed to a bridge plate 13, and can thread into the saddle housing 9. When the intonation screw 14 is turned, the saddle assembly 20 moves parallel with the strings 6, therefore desirably changing the string 6 scale length.

Figure 12:
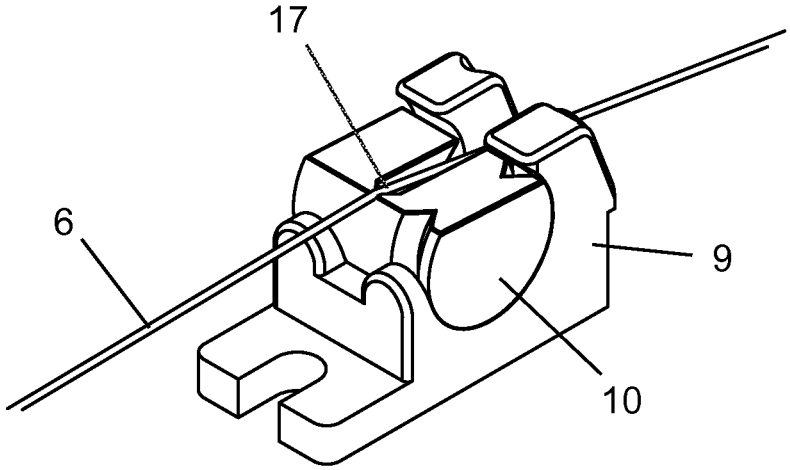
FIG. 12 shows a perspective front view of the saddle assembly with an alternate "exposed string" design in which an area of the string is exposed at the exact point where the string makes contact with the saddle. The exposed strings allow the playing musician to rest the palm of the hand directly on the strings, near the bridge and mute or dampen the sustaining, or ringing effect of the strings if desired.
Figure 13:
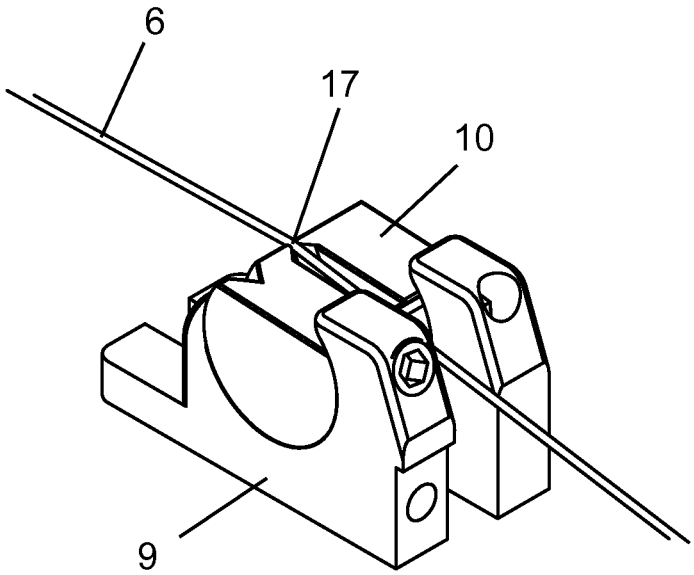
FIG. 13 shows a perspective back view of the saddle assembly with an alternate "exposed string" design in which an area of the string is exposed at the exact point where the string makes contact with the saddle. The exposed strings allow the playing musician to rest the palm of the hand directly on the strings, near the bridge and mute, or dampen the sustaining, or ringing effect of the strings if desired.

FIGS. 12 and 13 show an alternate exposed at 17 string 6 design whereas the top of the saddle 10, and saddle housing 9 has minimal material removed to expose at 17 the string 6 at the point of the leading edge of the saddle 10, for facilitating what is commonly called "palm muting" (the exposed strings allow the playing musician to rest the palm of the hand directly on the strings near the bridge and mute, or dampen sustain of the strings) playing techniques. Note that though material is removed from the top of the saddle 10 and the top of the saddle housing 9; overall integrity, adjustment, and sonic character the invention remain fully intact.

Figure 14:
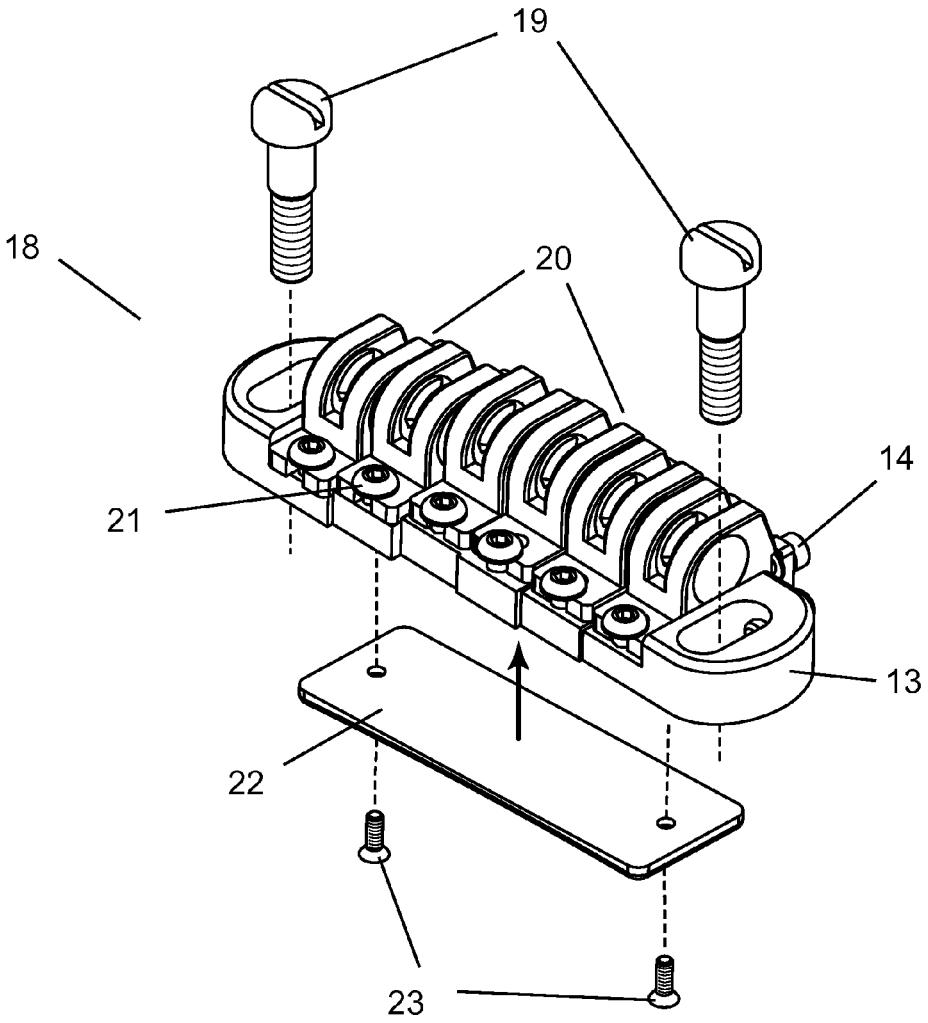
FIG. 14 details a perspective view of an alternate "two stud bridge" variation of the invention using two threaded studs to mount the bridge assembly to the instrument's body. Further illustrated is the incorporation of a connecting plate which allows the bridge plate to make direct contact with the instrument's body.
Figure 15:
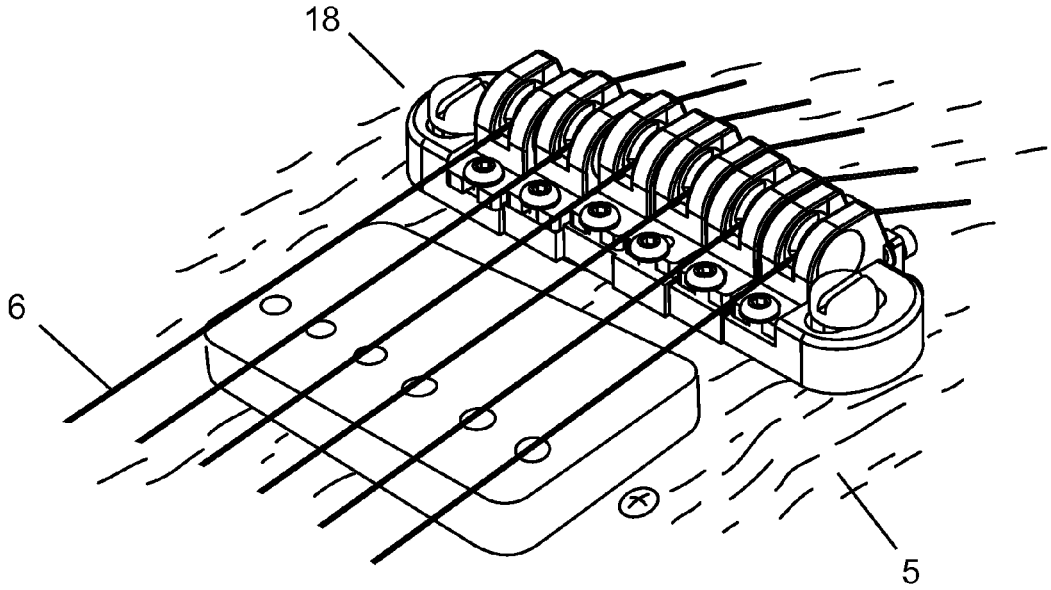
FIG. 15 shows a perspective view of the two stud mount bridge installed on an instrument's body with strings installed in the saddle assemblies.

FIGS. 14 and 15 illustrate an alternate two stud bridge 18 embodiment which incorporates the newly disclosed invention. Included are two threaded mounting studs 19, which pass through recesses in the bridge plate 13 and securely attach to the instrument's body 5. The saddle assemblies 20 sit securely atop of the bridge plate 13, and may utilize intonation adjustment screws 14, and for added stability, saddle assembly 20 locking screws 21. As it is desirable to employ a direct string-to-body coupling method, FIG. 16 also illustrates the use of a connecting plate 22, which can be affixed to the bottom of the bridge plate 13, through various methods. In this embodiment, the connection plate 22 is affixed to the bridge plate 13 via two fasteners 23.

FIG. 15 reveals the two stud bridge 18, affixed to the instrument's body 5 with strings 6 installed.

Figure 16:
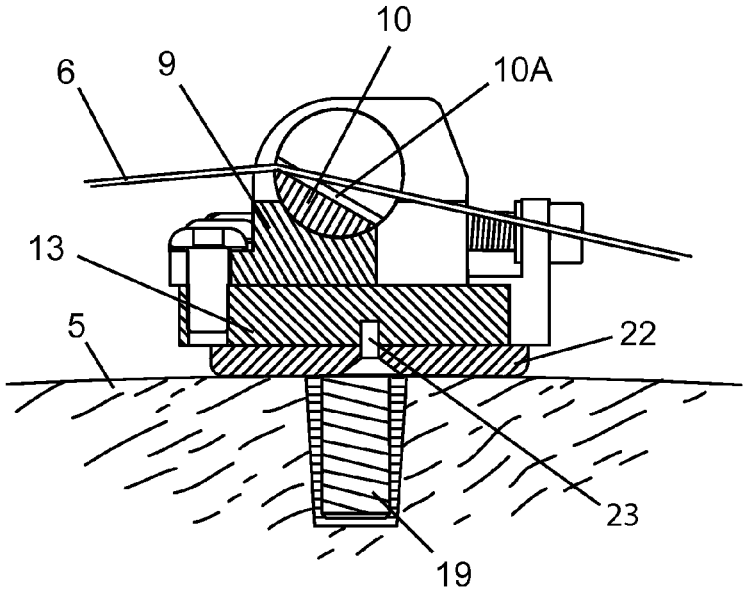
FIG. 16 shows an enlarged side section view of the two stud mount bridge illustrating how the string makes direct contact to the instrument's body through the bridge assembly. This view further depicts the use of the connecting plate which is sandwiched between the bridge plate and the instrument's body; thusly completing string-to-body direct coupling continuity, which improves musical tone and sustain.

FIG. 16 further reveals the string-to-body direct coupling method in which the vibrating string 6 rests in the string groove 10A located in the saddle 10, which in turn; the solid portion at the bottom of the saddle 10 makes contact with the solid portion in the bottom of the saddle housing 9, which in turn makes firm contact with the bridge plate 13, which in turn makes contact with the connecting plate 22, which contacts the instrument's body 5. FIG. 16 also illustrates the two stud bridge 18 firmly attached to the instrument's body 5 via the threaded mounting studs 19.

Figure 17:
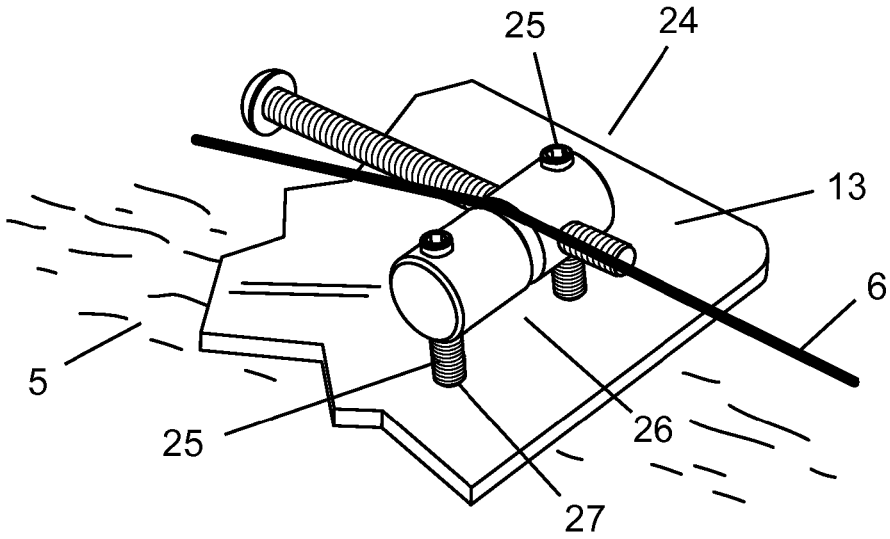
FIG. 17 details a perspective view of a common, and industry standard adjustable saddle assembly. This illustration demonstrates the presence of air gaps and voids between the string and the instrument's body.
Figure 18:
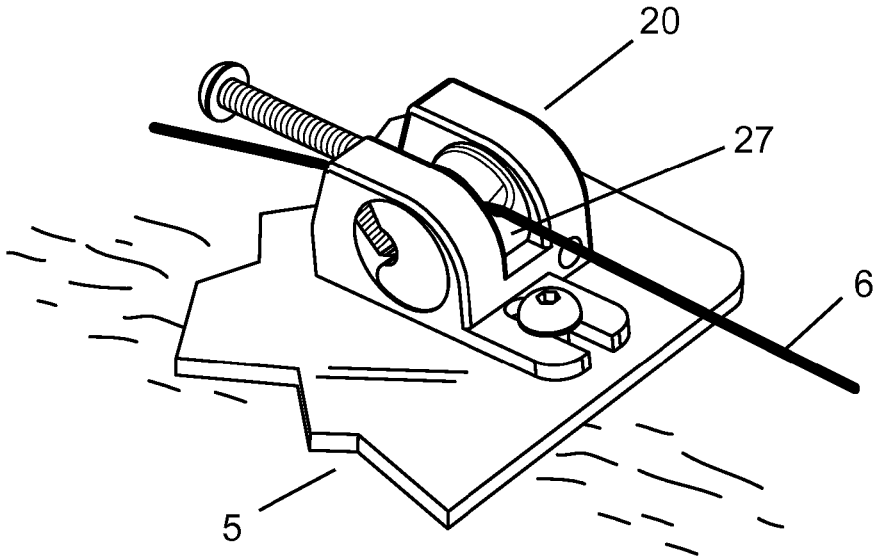
FIG. 18 is a perspective view of the new invention as described herein which illustrates direct coupling of the string to the instrument's body.

To further convey the significance of the new invention, FIGS. 17-18 show a side by side comparison of a typical, industry standard saddle assembly 24, compared to the new full contact saddle assembly 20 as disclosed in the invention herein. Note how the industry standard saddle assembly 24, found in FIG. 17, employs small screws 25 to adjust the string action height. This method creates undesired air gaps 26 between the vibrating string 6, the bridge plate 13, and the instrument's body 5. The only means of positive string vibration transference to the instrument's body 5 is through minimal contact points 27 found at the bottom of the set screws 25.

In contrast to FIG. 17, FIG. 18 illustrates the invention herein, which demonstrates the incorporation of a solid and stable mass 27 between the vibrating string 6 and the body 5 of the instrument. To improve musical sustain and tonality, it is most desirable to have a solid and stable, yet fully adjustable mass 27 between the vibrating string 6 and the body of the instrument 5.

Figure 19:
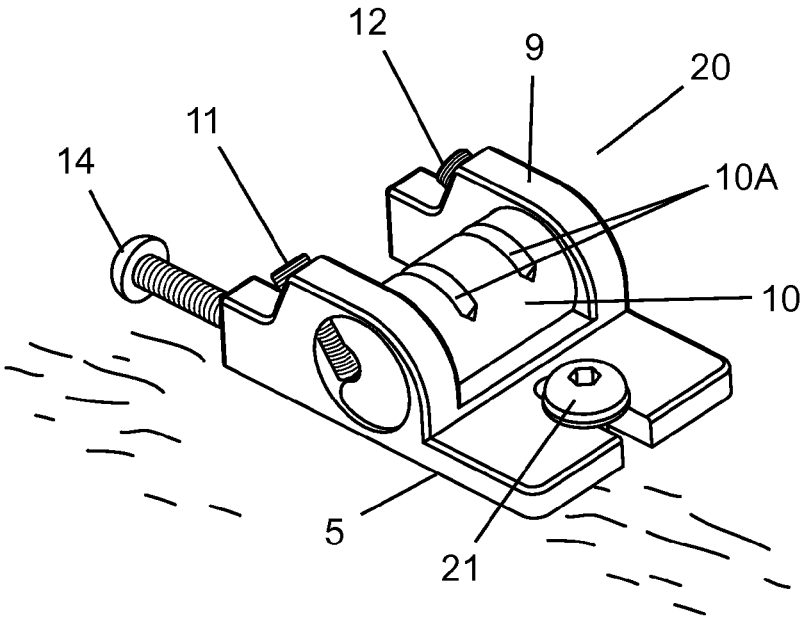
FIG. 19 depicts a perspective view of an alternate adaptation to the invention. This incarnation reveals how the same design features can be applied to an elongated saddle and saddle housing, whereby a multitude of string heights can be adjusted, then locked simultaneously, all the while maintaining full contact to the instrument's body.
Figure 20:
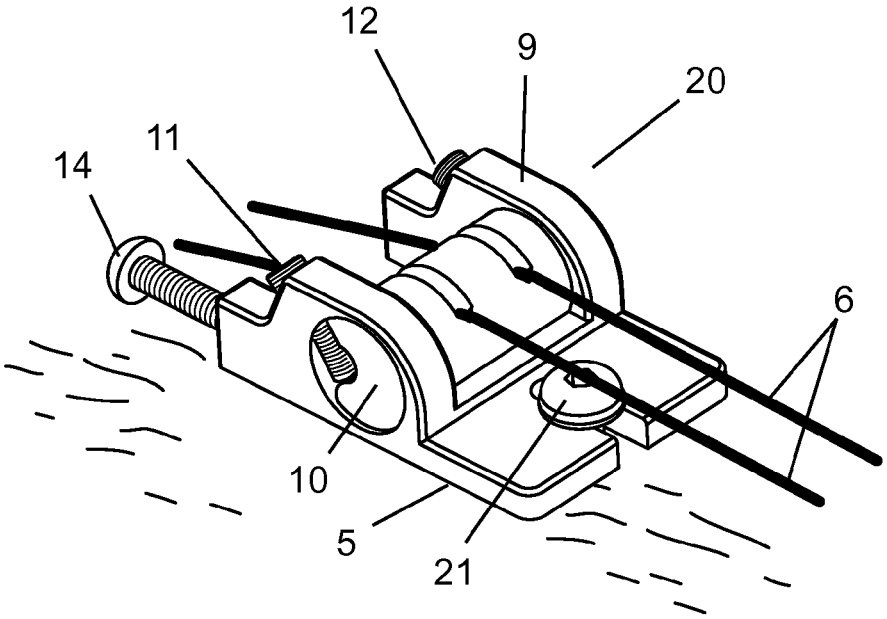
FIG. 20 depicts a perspective view of an alternate adaptation to the invention as described in FIG. 19, including the string installed into the saddle string grooves.

FIGS. 19 and 20 reveal an alternate design to the disclosed invention presented herein, in which the saddle 10 can include two or more string grooves 10A, for receiving more than one string 6. The saddle housing 9 can be altered in length to accommodate a saddle 10 of varying lengths, which is determined by the number of strings to be positioned in the saddle 10. As in the aforementioned single string saddle assembly 20, the height adjustment screw 11, and the locking set screw 12, perform in the same manner as does the intonation screw 14, and the saddle assembly locking screw 21. FIGS. 19 and 20 also reveal that full contact between the vibrating strings 6, and the instruments body 5 is maintained regardless of the saddle assembly 20 length, or how many strings 6 can be simultaneously adjusted for string action height 16.

Figure 21:
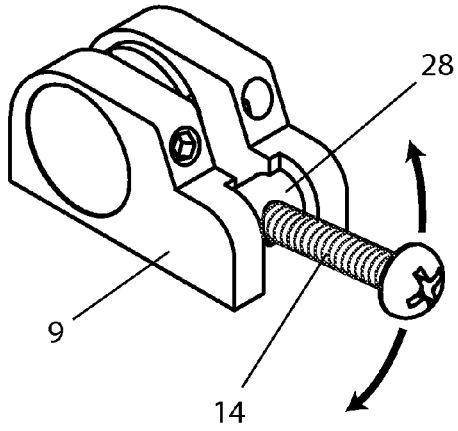
FIG. 21 illustrates a perspective view of a design variant which allows for a rotatable pin, moveably fitted in the housing, which acts as a receptor for the intonation adjustment screw. This allows the intonation adjustment screw to align and engage with intonation screw holes of variable positions found on the bridge plate.
Figure 22:
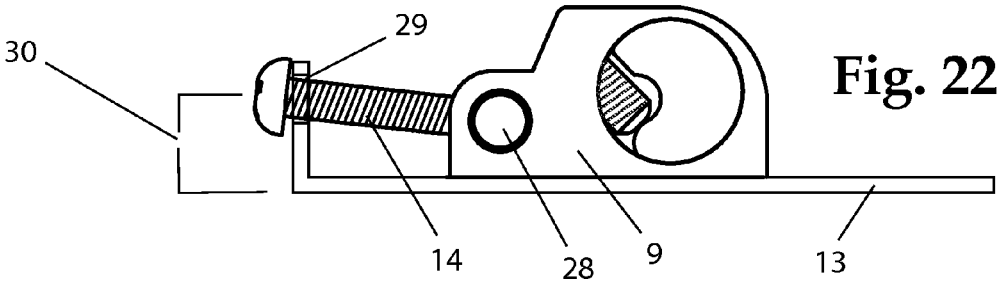
FIGS. 22-23 show side view comparisons of the high and low intonation screw hole position variables potentially found on bridge plates. Also shown is the intonation adjustment screw properly rotated and engaged with the intonation screw hole in either the high or low position.
Figure 23:
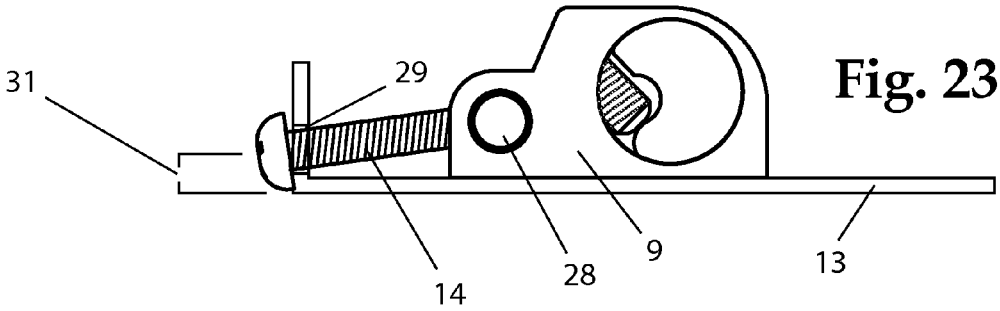

FIG. 21-23 illustrate another design feature in accordance with the teachings of the present invention, wherein the housing 9 holds a rotatable pin 28 which has a threaded hole and therefore can be the recipient of the intonation adjustment screw 14. This design allows the intonation adjustment screw 14 to move up or down freely and locate with the intonation screw hole 29 found on bridge plate 13. This feature is desirable because the intonation screw hole 29 positions often fluctuate in height due to variables in the manufacturing process of the bridge plate 13.

FIGS. 22 and 23 further illustrate the above by detailing a side by side comparison. FIG. 22 shows the intonation adjustment screw 14 engaged with the intonation screw hole 29 which is in a nominal high position 30. In contrast, FIG. 23 shows the intonation adjustment screw 14 engaged with the intonation screw hole 29 which is in a nominal low position 31.

I claim:

1. A stringed musical instrument comprising of:

a body having a top and a back; a neck having fingerboard and headstock with tuners; an bridge plate secured to the body; one or more saddle assemblies secured to the bridge, each assembly having a saddle and saddle housing; one or more strings stretched from the tuners, over the neck and fretboard then over a portion of the top of the body to contact points on the saddle; each saddle assembly having a string height saddle adjustment system for varying the distance of an individual string from the fingerboard and body, wherein the saddle is cylindrically shaped and includes a recess for holding the string, and is encapsulated by and rotatable within the saddle housing and comprising said string height saddle adjustment system;

said musical instrument including a lever portion within the saddle having an edge, that upon movement of the lever portion moves the saddle recess upward or downward, in turn moving the string upward or downward.

2. The musical instrument of claim of claim 1 wherein the saddle has a bottom that makes direct contact with an interior of the saddle housing.

3. The musical instrument of claim 1 wherein the saddle housing has a bottom that makes firm contact to the bridge.

4. The musical instrument of claim 3 wherein the saddle housing bottom makes contact with the bridge plate that in turn connects to the top of the instrument's body.

5. A string height saddle adjustment system for varying the distance of an individual string from the fingerboard and body comprising a saddle and a saddle housing for mounting on the bridge plate of a musical instrument, the saddle being encapsulated by and rotatable within the housing and including a recess for holding a string, said musical instrument including a lever portion within the saddle having an edge, that upon movement of the layer portion moves the saddle recess upward or downward, in turn moving the string upward or downward.

6. The saddle system of claim 5 including a string height adjustment screw held within said housing.

7. The saddle system of claim 5 including a saddle locking screw held within said housing.

8. The saddle system of claim 5 including an intonation adjustment screw held within said housing.

9. The saddle system of claim 5 including means for temporarily fastening the saddle housing to the bridge plate.

10. The saddle system of claim 5 wherein the saddle is semi-cylindrical and encapsulated in a partially enclosed housing that encapsulates the saddle, yet allows the saddle to rotate clockwise or counterclockwise within the saddle housing.

11. The saddle system of claim 5 including a removable connecting plate for transmitting sonic output from a vibrating string to the instrument's body.

12. The saddle system of claim 11 wherein the connecting plate is contoured to the shape of the instrument's body top.

13. The saddle system of claim 5 wherein the saddle is so constructed as to accommodate a plurality of strings in a single saddle system.

14. The saddle system of claim 13 including a string height adjustment screw held within said housing for adjusting a plurality of strings.

15. The saddle system of claim 13 including a saddle locking screw held within said housing for locking a plurality of strings.

* * * * *